United States Patent [19]

Staley

[11] Patent Number: 4,989,487

[45] Date of Patent: Feb. 5, 1991

[54] ANVIL ASSEMBLY FOR A SLITTING MACHINE

[76] Inventor: John P. Staley, P.O. Box 36116, Greensboro, N.C. 27416

[21] Appl. No.: 383,714

[22] Filed: Jul. 24, 1989

[51] Int. Cl.[5] ..... B26D 1/22

[52] U.S. Cl. ..... 83/506; 83/434; 83/659

[58] Field of Search ..... 83/659, 347, 348, 346, 83/495, 505, 506, 434

[56] References Cited

U.S. PATENT DOCUMENTS

| | | | |
|---|---|---|---|
| 3,677,122 | 7/1972 | Rautine | 83/506 |
| 4,045,196 | 8/1977 | Schaefer | 65/2 |
| 4,455,903 | 6/1984 | Kesten | 83/346 |
| 4,771,666 | 9/1988 | Ikeuchi et al. | 83/99 |

FOREIGN PATENT DOCUMENTS

| | | | |
|---|---|---|---|
| 1014592 | 12/1965 | United Kingdom | 83/347 |

*Primary Examiner*—Hien H. Phan

*Assistant Examiner*—John M. Husar

*Attorney, Agent, or Firm*—Rhodes, Coats & Bennett

[57] ABSTRACT

The present invention is an anvil assembly for a slitting machine of the type including an arbor having a plurality of laterally spaced cutting disks mounted thereon. The anvil assembly is mounted to the slitting machine adjacent to the cutting discs. The anvil assembly includes a generally cylindrical core and a plurality of anvil rings which are concentrically disposed about the core under normal unloaded conditions. The anvil rings include an outer cutting surface which is in rolling contact with at least one of the cutting discs on the slitting machine. The anvil rings are resiliently supported in spaced relationship to the core so that when a load is applied to the anvil ring, the anvil ring will move radially with respect to the core independently of the other anvil rings. The resilient support means includes a plurality of support pins extending radially from the core member, and means for biasing the support pins into engagement with the inner bearing surface of the anvil rings.

22 Claims, 5 Drawing Sheets

ANVIL ASSEMBLY FOR A SLITTING MACHINE

FIELD OF THE INVENTION

The present invention relates to an apparatus for slitting sheet material, such a plastic, paper or fabric and more particularly to an anvil for such an apparatus.

BACKGROUND OF THE INVENTION

Slitting machines for cutting sheet material such as plastic, paper or fabric are well known in the art. Typically, a slitting machine employs an arbor having a plurality of circular cutting discs laterally spaced thereon. The edge of the cutting discs rotate against an anvil which is mounted on a arbor adjacent to the cutting discs. As sheet material is feed between the cutting discs and anvils, it is cut strips of material.

One of the problems associated with slitting machines is that proper operation depends on maintaining engagement of the cutting knives with the anvils. The engagement of the cutting knives with the respective anvils can be affected by many factors including variations in the diameter of the cutting knives or anvils, eccentricity of the cutting knives or anvils, flexing of the arbors, and wear of the cutting knives and anvils.

In order to compensate for the above mentioned problems, attempts have been made to resiliently mount the anvils. One approach has been to employ a core around which a plurality of anvil rings are resiliently mounted. This approach is illustrated in U.S. Pat. No. 3,677,122. The above mentioned patent discloses a slitting machine having first and second arbors. A cutting disk is mounted to the first arbor. The anvil assembly comprises a first annular ring mounted to the second arbor. A second annular ring is concentrically disposed about the first annular ring. An elastomer means is disposed between the first and second annular rings for resiliently holding the annular rings into pre-loaded engagement with at least one cutting disc on the first arbor.

While the device described in the '122 patent has a number of drawbacks. First, since the elastomer means is disposed between the first and second and the annular rings, it limits radial displacement of the outermost annular ring. Further, because the elastomer means is bonded to both the core and the annular rings, relative movement between the first and second annular is not possible. Another drawback of the anvil described in the '122 patent is that no means is provided for varying the resistance of on the annular rings to radial displacement. Finally, since the elastomer means generally has a relatively low melting point, the anvil means of the '122 patent has limited utility in applications where heating is required.

SUMMARY AND OBJECTS OF THE INVENTION

The present invention is an anvil assembly for a slitting machine of the type used to slit sheet material into a plurality of thin strips. The anvil includes a generally cylindrical core formed with an axially extending bore and a plurality of radially extending holes. A plurality of annular shaped anvil rings are concentrically disposed about the core. Each anvil ring includes an outer cutting surface and an inner bearing surface. The outer cutting surface of each anvil ring is adapted for rolling engagement with at least one of the cutting discs on the slitting machine.

The anvil assembly includes means for resiliently supporting the anvil rings so that the anvil rings are radially moveable independently of one another. The support means includes a resilient member inserted into the axial bore of the core member, and a plurality of support pins. The support pins are inserted into respective radial holes in the core member such that the inner end of the support pin engages the resilient member in the core and the outer terminal end engages the inner bearing surface of the anvil rings. In an unloaded condition, the anvil rings are concentrically disposed about the core. When a load is applied to the anvil rings, the support pin in the vicinity of the applied force compresses the resilient member in the core to permit the anvil rings to move radially with respect to the core.

In a preferred embodiment of the invention, the resilient member comprises a tube constructed of a resilient material such as rubber. Air under pressure is admitted into the tube. By varying the pressure within the tube, the resistance of the anvil rings to radial displacement can be increased or decreased. Further, the air admitted into the tube can be useful for dissipated heat, particularly in application where the cutting discs are heated.

Based on the foregoing, it is apparent that the primary object of the present invention is to provide an anvil means for a slitting machine which compensates for such problems as eccentricity of the cutting disks and anvil rings, variations in the diameter between cutting disks and anvil rings, flexing of the arbors, wear of the cutting disks and anvil rings, and other factors effecting rolling engagement of the cutting disks with the anvil rings.

Another object of the present invention is to provide an anvil means comprising a plurality of anvil rings each of which are mounted in pre-loading rolling engagement with at least one cutting disk and which are radially moveable independent of one another.

Another object of the present invention is to provide an anvil assembly comprising a plurality of anvil rings mounted in pre-loaded engagement with cutting disk on the slitting machine wherein the resistance of the anvil rings to radial displacement can be varied.

Other objects and advantage of the present invention will become apparent and obvious from a study of the following description and the accompanying drawings which are merely illustrative of such invention.

BRIEF DESCRIPTION OF THE INVENTION

DETAILED DESCRIPTION OF THE INVENTION

Figure 1:
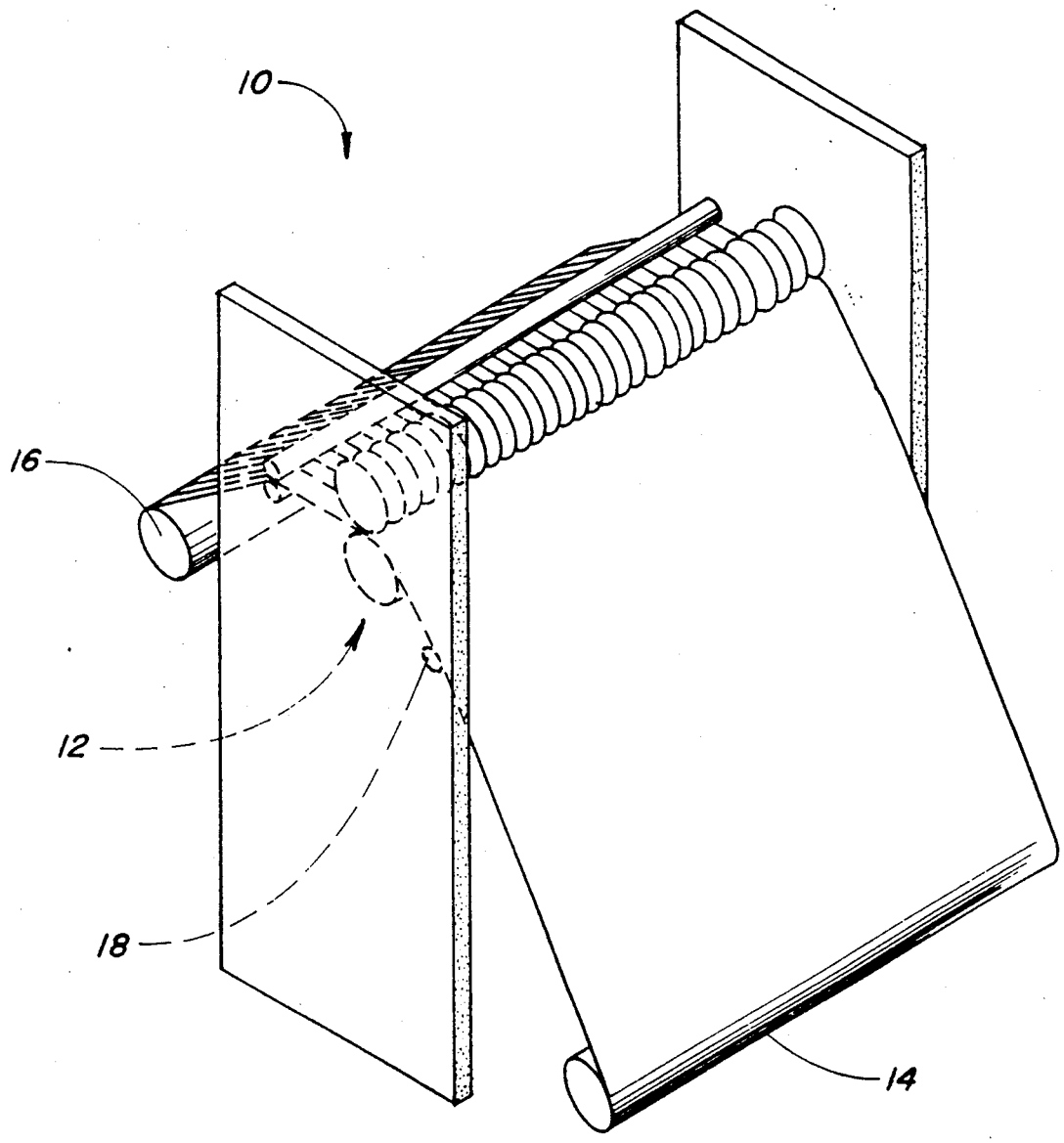
FIG. 1 is a schematic diagram of a slitting machine.

Referring now to the drawings, there is shown schematically in FIG. 1 a slitting apparatus indicated generally by the numeral 10. The slitting apparatus 10 includes a cutting means 12 for cutting sheet material into a plurality of strips, a feed roll 14 for feeding the sheet material through the cutting means 12, and a take-up roll 16 for taking up the slitted sheet material. A idler shaft 18 may be provided between the feed roll 14 and cutting means 10.

The cutting means 12 generally comprises a cutter assembly 20 and an anvil assembly 30. The cutter assembly 20 includes a rotating shaft 22 which is driven in a conventional manner. A plurality of circular cutting discs 24 are fixed to and axially spaced along the shaft 22.

The anvil assembly 30 of the present invention is mounted to the frame of the slitting machine 10 adjacent to the cutter assembly 20. Generally speaking, the anvil assembly includes a plurality of anvil rings 44 each of which are biased into rolling engagement with at least one cutting disc 24 of the cutter assembly 20. As the sheet material passes between the cutting discs 24 and anvil rings 44, the material is cut into thin strips.

Referring now to FIGS. 2-5, it is seen that the anvil assembly includes a generally cylindrical core member 32 made of a tool grade carbon steel. The core member 32 includes a smooth central portion 38 and threaded end portions 40. The core member 32 is formed with an axial bore 34. The end portions of the axial bore are enlarged so as to define an outwardly facing shoulder 36 adjacent each end of the axial bore 34. A plurality of radially extending holes 42 are formed in the smooth central portion 38 which extend from the outer circumference of the core 32 to the axial bore 34. Preferably, the radial holes 42 are arranged in staggered columns and rows as will be hereinafter described in detail.

A plurality of annular shaped anvil rings 44 are disposed in circumferential spaced relation about the core 32. In the illustrated embodiment, there are twenty anvil rings 44 although a greater or lesser number can be used. Each of the anvil rings includes a cutting surface 46, an inner bearing surface 48, and opposing side faces 50. In the embodiment shown, the anvil rings 44 are disposed in side-by-side relation so that the side faces 50 of one anvil ring 44 engage the side faces 50 of the adjacent anvil rings 44. If greater spacing is desired, spacer sleeves (not shown) may be employed between anvil rings 44. Preferably, the number of anvil rings 44 is equal to the number of cutting disc 24 and are spaced such that one cutting disc 24 is disposed in opposed relation to each anvil ring 44.

The anvil rings 44 are retained on to the core 32 by means of lock nuts 56 which are screwed onto the threaded ends 40 of the core member 32. In the embodiment shown, there are two pairs of lock nuts 56. The innermost lock nut 56 in each pair is threaded onto the core member 32 until the lock nut 56 in each pair engages the side face 50 of the outermost anvil ring 44. The outermost lock nut 56 in each pair is then threaded on to the core member 32 until it engages the first or innermost lock nut 56. The lock nuts 56 have tool slots 58 formed in the edge for the insertion of a tool to facilitate tightening of the lock nuts 56 against one another.

It will be apparent that the axial position of the anvil rings 44 with respect to the core member 32 can be adjusted by the relatively simple means of loosening a first set of lock nuts 56, shifting the anvil rings 44, and retightening the second pair of lock nuts 56. For instance, if it is desired to adjust the anvil rings 44 to the left, the first pair of lock nuts 56 on the left side of the anvil rings 44 are loosened and threaded away from the anvil rings 44. Once the lock nuts on the left are positioned at the desired location, they are tightened against one another to establish the new position. The anvil rings 44 can then be slid laterally into abutting relationship with the first set of lock nuts 56. The second pair of lock nuts 56 to the right of the anvil rings 44 are then retightened against the anvil rings 44.

The anvil rings 44 are resiliently supported in spaced relation to the core 32 by a resilient support means. In the embodiment shown, the resilient support means comprises a plurality of radially extending support pins 52 which are inserted into respective radial holes 42 in the core and a biasing means for biasing the support pins 52 into engagement with bearing surface 48 of the anvil rings 44. The biasing means may comprise a resilient member inserted into the axial bore 34 of the core member 32, which in the embodiment shown is a resilient tube 54. The inner end of each support pin 52 bears against the resilient tube 54. The outer end of the support pin 52 bears against the bearing surface 48 of the anvil ring 44.

Figure 2:
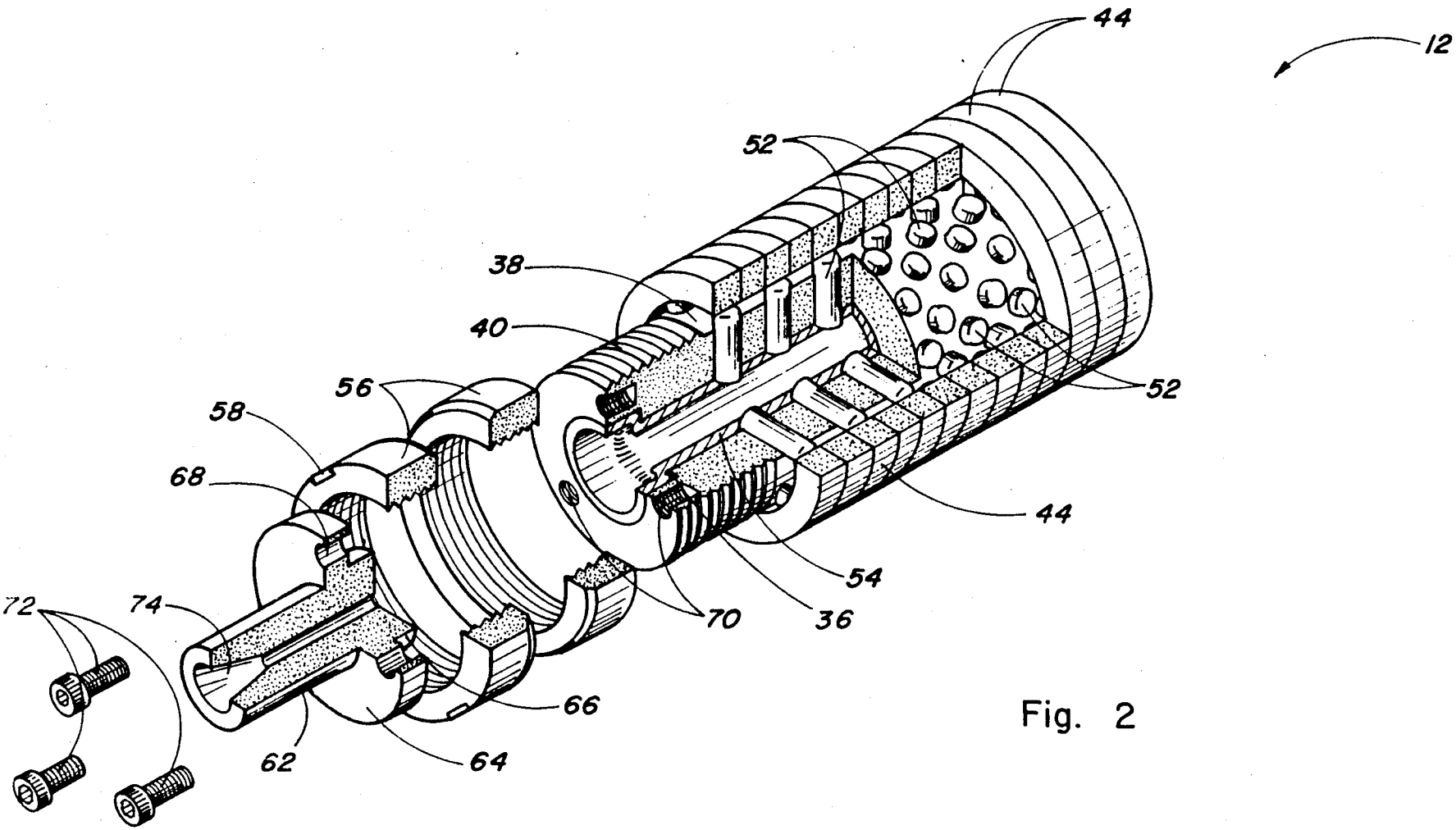
FIG. 2 is an exploded perspective view of the anvil assembly with a quarter section removed for purposes of illustration.
Figure 3:
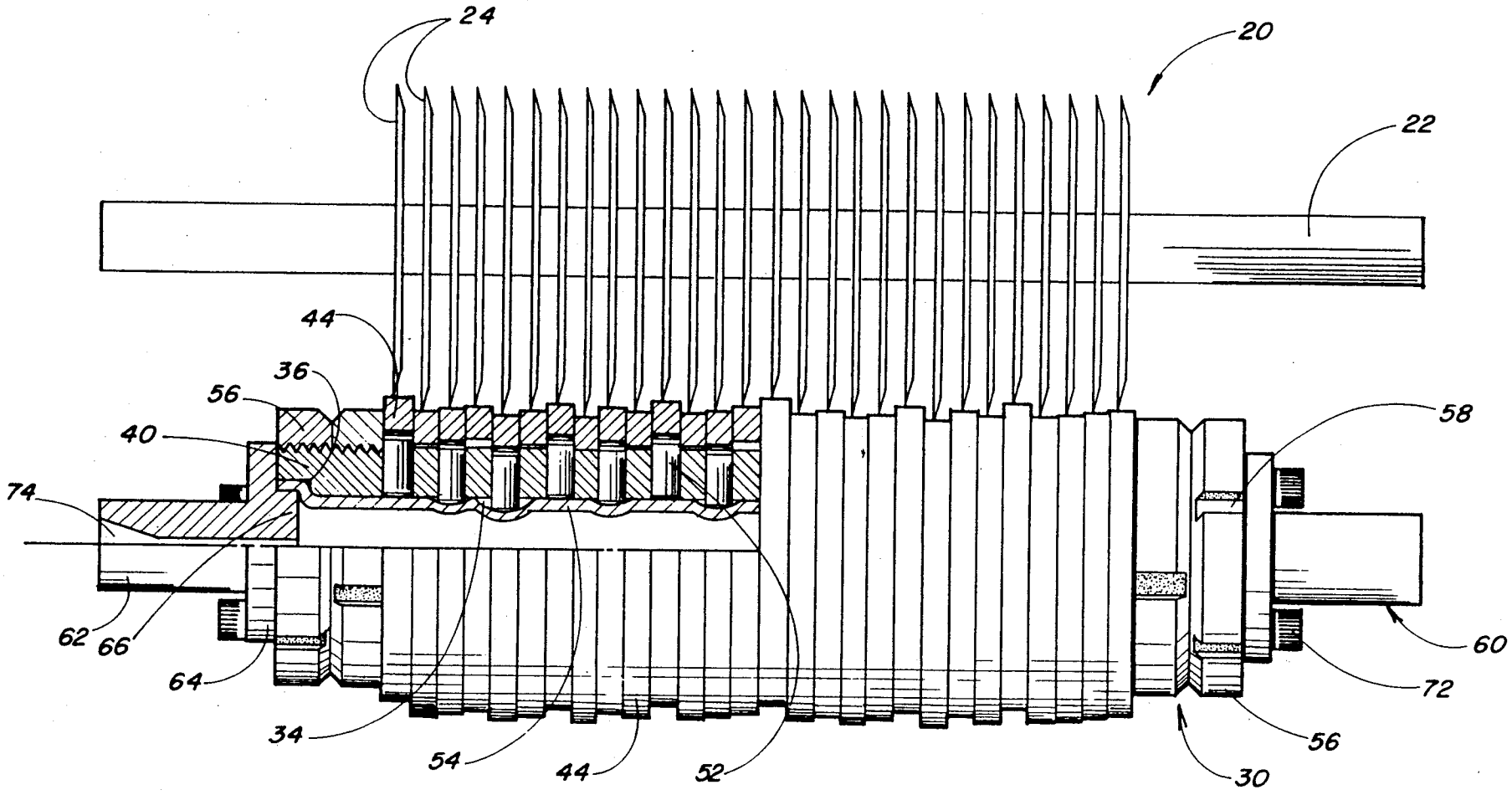
FIG. 3 is an elevation view of the anvil assembly with a quarter section removed for purposes of illustration.

As shown best in FIG. 2, the support pins 52 and their associated holes 44 are arranged in staggered columns and rows. For purposes of this application, a series of support pins 52 and/or radial holes 42 which are circumferentially aligned are referred to as a row. A series of support pins 52 and/or radial holes 42 which are aligned axially are referred to as a column.

Figure 4:
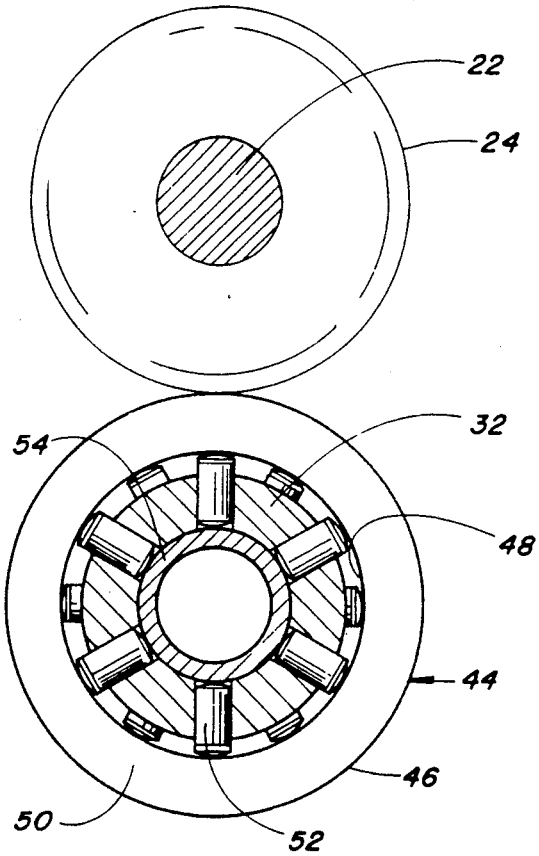
FIG. 4 is a cross section of the anvil assembly in a no-load condition.
Figure 5:
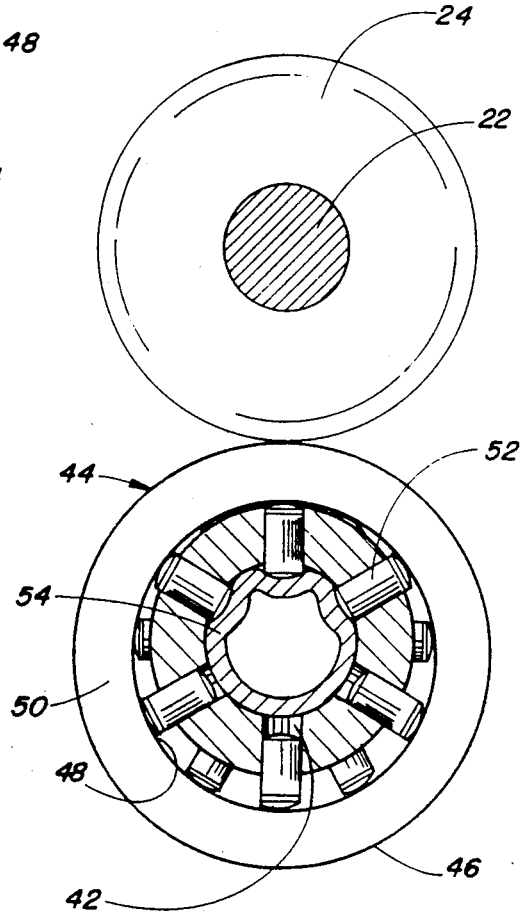
FIG. 5 is a cross section of the anvil assembly in a loaded condition.
Figure 6:
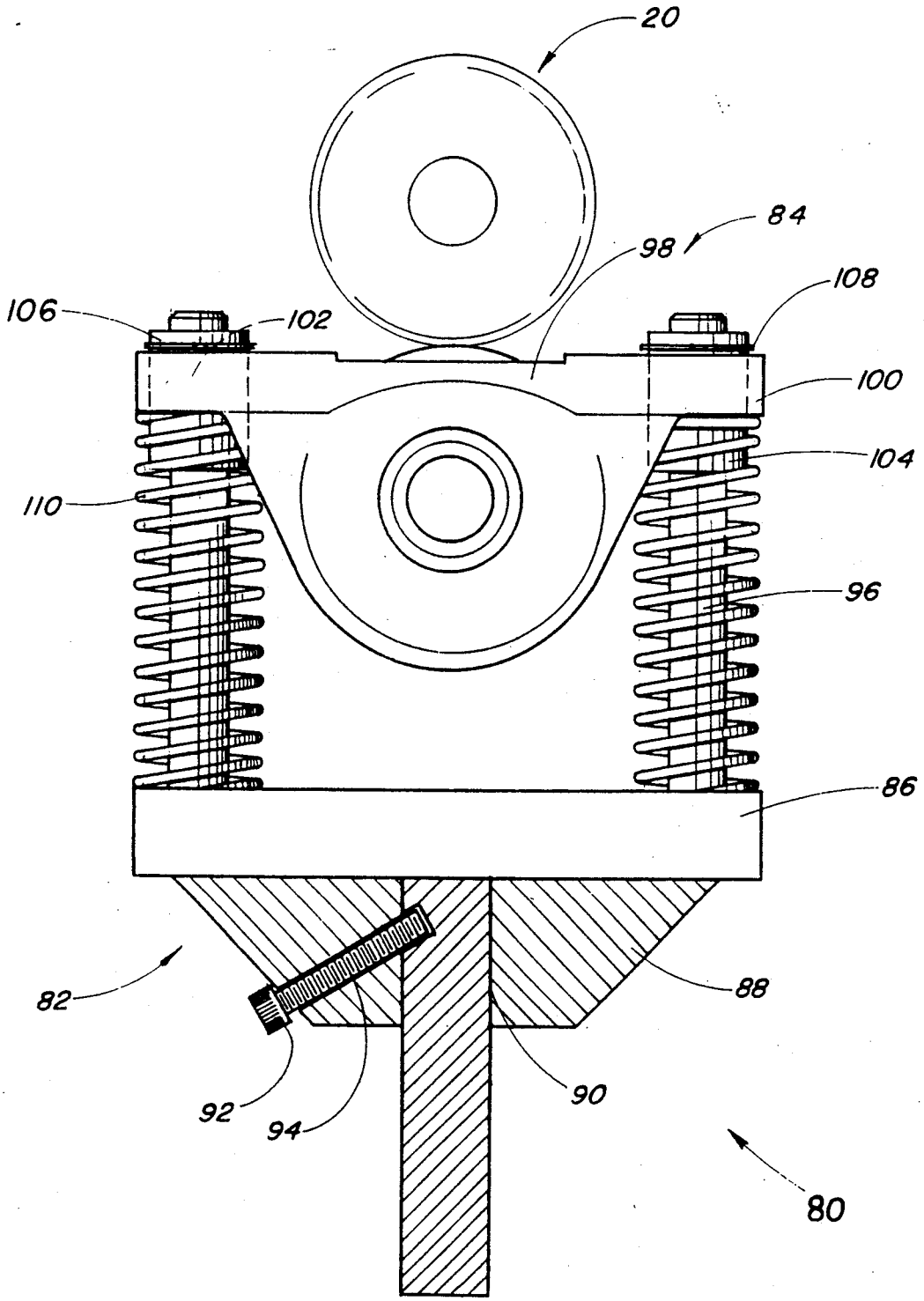
FIG. 6 is an elevation of the support assembly for mounting the anvil assembly to the slitting machine.

In the illustrated embodiment of the invention, there are a minimum of six equally spaced support pins 52 in each circumferential row and ten support pins 52 in each axial column. The support pins 52 in a single circumferential row support a single anvil ring 44 as best shown in FIG. 4. Also, it should be readily apparent that the number of rows is equal to the number of anvil rings 44. The support pins 52 in a single column support every other anvil ring 44. In other words, the support pins 52 in one column support odd number anvil rings 44, while the support pin in adjacent columns support even number anvil rings 44.

Under no load conditions, the support pins 52 and biasing means holds the anvil rings 44 in concentric relation with the core member 32. When a load is placed on the anvil rings 44 in any radial direction, the biasing means yields to allow the anvil ring 44 to move radially in the direction of the applied force so that it assumes an eccentric position with respect to the core member. As shown best in FIG. 5, the support pins 52 in the vicinity of the applied load are pressed into the core 32. The inner end of the pins 52 collapses the wall structure of the tube 54 which is biasing the support pin 52. When the load on the anvil ring 44 is removed, the tube 54 pushes the pins 52 back to their original position so that the anvil rings 44 again assumes a concentric position with respect to the core 32.

The anvil assembly also includes a pair of endcaps 60 which are bolted to opposite ends of the core member 32. Each endcap 60 includes a bearing shaft 62, a radially extending flange 64, and hub 66. The flange 64 is formed with six circumferentically spaced throughholes 68 which align with threaded holes 70 in the ends of the core member 32. Allen head screws 72 extend through the throughholes 68 in the endcap and are threaded into the threaded holes 70 to secure the endcap 60 to the core member 32. When the endcap 60 is secured to the core member 32, the hub 66 presses the resilient tube 54 against the outwardly facing shoulder 36 to form an air tight and water tight seal. An inlet passage 74 extends axially through the endcap 60 for supplying air or fluid to the inside of the resilient tube 54. It will be readily apparent that by varying the pressure within the core of the anvil means, the compressibility of the resilient tube 54 can be varied. Thus, the resistance of the anvil rings 44 to radial displacement can be increased or decreased.

The anvil assembly 30 is rotatively mounted to the frame of the slitting machine by a pair of support means. In the embodiment shown, the support means includes a lower support member indicated generally by the numeral 82 and an upper support member generally indicated by the numeral 84. The lower support member 82 includes a horizontal bar 86. A pair of trapezoidal blocks 88 extend downwardly from the horizontal bar 86 and define a channel 90. An angular set screw 92 extends through a tapped hole 94 in one of the support blocks for securing the lower support member 82 to the frame of the slitting machine. A pair of parallel support rods 96 extend upwardly from the horizontal bar 86.

The upper support member is slidably mounted on the support rods 96 and are vertically movable thereon. The upper support member 84 comprises a pillow block 98 having laterally extending wing portions 100. The wing portion 100 are formed with throughholes 102. Slide bearings 104 are fitted into the through holes 102. The slide bearings 104 include circumferential grooves 106 adjacent each end adapted to receive a snap ring 108.

The support rods 96 of the lower support member 82 are inserted into the slide bearings 104 of the upper support member 84. A pair of compression coil springs 110 are concentrically disposed about each of the support rods 96. The lower end of the spring 110 engages the horizontal bar 86. The upper end of each spring 110 engages the underside of the pillow block 98. Thus, the upper support member is resiliently supported with respect to the lower support.

The anvil assembly 30 is rotatively mounted in the support means. In particular, the bearing shaft 62 of each endcap 60 is rotatively journaled in a respective pillow block 98. The anvil assembly 30 is mounted in the support mean 80 such that the anvil rings are in rolling engagement with at least one cutting disc 24. Further, it is preferred that the spacing between the axis of the core assembly 30 and axis of the cutter assembly 20 is such that a small load is placed on the anvil rings. Preferably, the anvil rings 44 should be initially moved off center with respect to the core 32 by half its full range. For instance, if the range of radial movement is ½," then the rings 44 should be compress 1/16" off center. This assures that the anvil rings 44 remain in contact with their respective discs 24 changes in diameter of the discs 24.

During operations of the slitting machine, the anvil rings 44 of the anvil assembly 30 will move independently of each other, either radially inward or outward with respect to the core member 32 to accommodate for problems such as eccentricity of the cutting discs and anvil rings 44, variation in diameter of cutting discs or anvil rings, flexing of the arbors, or wear of the cutting discs and anvil rings. Also, since the core assembly 30 is resiliently mounted on its support means 80, part of the load which would otherwise be compensated for by the biasing means, can be taken by the springs 110. When the collective load applied to the biasing means exceeds a predetermined amount, the excess load serves to compress the springs 110 in the mounts 80. By varying the pressure within the core 32, the distribution of the load between the biasing means and mounts 80 can be adjusted.

Another advantage of the present invention is that the air or fluid used to pressurize the core 32 may also serve to dissipate heat which is conducted through the anvil assembly 30. Thus, the present invention may be used in applications where the cutting discs 24 are heated.

What is claimed is:

1. A resiliently supported anvil assembly for a slitting machine having a cutter assembly including a plurality of spaced apart cutting discs for cutting sheet material into strips, the anvil assembly comprising:

(a) a generally cylindrical core formed with an axially extending bore and a plurality of radial holes extending from the outer circumference of the core to the axial bore;

(b) a plurality of anvil rings disposed in spaced relationship about the core, each of the anvil rings including an outer cutting surface in rolling engagement with at least one of the cutting discs on the slitting machine and an inner bearing surface, the inside diameter of the anvil rings being greater that the outside diameter of the core;

(c) means for resiliently supporting the anvil rings in spaced relationship to the core so as to be movable radially with respect to the core; said support means including:

(1) an elastic member inserted into the axial bore of the core member;

(2) a plurality of support pins inserted into respective radial holes in the core such that the inner end thereof engages the elastic member and opposite end projects outwardly from the core to engage the inner bearing surface of the anvil rings.

2. The anvil assembly according to claim 1 wherein the support pins and their associated radial holes are arranged in staggered columns and rows, with the support pins in one column or row being offset with the support pins in adjacent columns and rows.

3. The anvil assembly according to claim 2 wherein there are at least six support pins and associated holes in each circumferential row.

4. The anvil assembly according to claim 1 wherein the anvil rings are axially spaced along the core member in side-by-side relationship so that the side faces of one anvil rings abut the side faces of adjacent anvil rings.

5. The anvil assembly according to claim 1 wherein the elastic member comprises a tube having a collapsible wall structure.

6. The anvil assembly according to claim 5 wherein air under pressure is admitted into said tube.

7. The anvil assembly according to claim 1 further including resilient mounts for supporting the core and associated anvil rings in spaced relation from the cutter assembly so that the anvil rings maintain pre-loaded rolling engagement with the cutting discs.

8. The anvil assembly according to claim 7 wherein the core is rotatably journaled within the resilient mounts.

9. The anvil assembly according to claim 8 wherein the resilient mounts include a first support member securable to the slitting machine, a second support member in which the core is rotatably journaled, and means for biasing the first and second support members apart.

10. The anvil assembly according to claim 9 wherein the means for biasing the first and second support members comprises at least one spring means disposed between the first and second support members.

11. An anvil assembly comprising:

(a) a cylindrical core having a plurality of radially extending holes;

(b) a plurality of anvil rings, each of which has an inner bearing surface and an outer cutting surface in rolling engagement with a cutter; and (c) means for resiliently supporting each anvil ring in spaced relationship about the core so that the anvil rings are radially moveable with respect to the core independently of one another, the support means including:

(1) a plurality of support pins inserted into respective radially extending holes for supporting each anvil ring, said support pins being moveable between an extended position and a retracted position; and (2) means for resiliently biasing the support pins towards an extended position so as to engage the inner bearing surface of the anvil rings, wherein the support pins are moveable to a retracted position when a load is applied to the anvil rings.

12. The anvil according to claim 11 wherein the core further includes an axial bore from which said radial holes extend, and wherein said biasing means is disposed within said axial bore.

13. The anvil according to claim 12 wherein said biasing means is air under pressure.

14. The anvil according to claim 12 wherein said biasing means is fluid under pressure.

15. The anvil according to claim 12 wherein said biasing means is an elastic member.

16. The anvil according to claim 15 wherein said elastic member is a tube constructed of a resilient material.

17. The anvil according to claim 16 wherein air under pressure is admitted into said resilient tube.

18. The anvil assembly according to claim 11 further including means for axially positioning said anvil ring with respect to the core.

19. The anvil according to claim 18 wherein said core includes threaded end portions and wherein said positioning means includes a lock nut threaded onto each of the end portions of the core so as to sandwich the anvil ring between the lock nuts.

20. An anvil assembly for a slitting machine having a cutter assembly including a plurality of axially spaced cutting disks for cutting sheet material into a plurality of strips, the anvil assembly comprising:

(a) a generally cylindrical core having threaded end portions:

(b) means for rotatably mounting the core to the slitting machine;

(c) an axial bore extending axially through the core, said axial bore having at least one open end;

(d) a plurality of radial holes extending from the outer circumference of the core to the axial bore;

(e) a plurality of anvil rings disposed in spaced relationship about the core, each of the anvil rings including an outer cutting surface in rolling engagement with at least one of the cutting discs on the slitting machine and an inner bearing surface which is larger in diameter than the core so as to define an annular space between the anvil rings and core;

(f) a pair of lock nuts for holding the anvil rings on the core, said lock nuts being threaded onto each end of the core so as to engage the outermost anvil rings;

(g) means for resiliently supporting the anvil rings in spaced relationship to the core so as that the anvil rings are moveable radially with respect to the core, said support means including:

1. an elastic member inserted into the axial bore of the core; and 2. a plurality of support pins received in respective radial holes in the core such that one end thereof engages the elastic member and the opposite end projects outwardly from the core to engage the inner bearing surface of the anvil ring.

21. The anvil assembly according to claim 20 wherein the elastic member comprises a tube having a resilient wall structure.

22. The anvil assembly according to claim 21 wherein air under pressure is admitted into the resilient tube in the core.

* * * * *